US007216814B2

(12) United States Patent
Gardega

(10) Patent No.: US 7,216,814 B2
(45) Date of Patent: May 15, 2007

(54) APPARATUS FOR THERMAL SPRAY COATING

(75) Inventor: Thomas Gardega, Conway, SC (US)

(73) Assignee: Xiom Corp., Babylon, NY (US)

( * ) Notice: Subject to any disclaimer, the term of this patent is extended or adjusted under 35 U.S.C. 154(b) by 189 days.

(21) Appl. No.: 10/909,115

(22) Filed: Jul. 30, 2004

(65) Prior Publication Data

US 2005/0082395 A1 Apr. 21, 2005

Related U.S. Application Data

(60) Provisional application No. 60/509,948, filed on Oct. 9, 2003.

(51) Int. Cl.
*B05C 5/04* (2006.01)

(52) U.S. Cl. ..... 239/85; 239/79; 239/128; 239/135; 239/290; 239/296; 219/121.47; 219/121.51

(58) Field of Classification Search ..... 239/79, 239/85, 128, 135, 290, 296, 403, 405, 422–424.5, 239/428; 219/121.47, 121.51
See application file for complete search history.

(56) References Cited

U.S. PATENT DOCUMENTS 2,643,955 A * 6/1953 Powers et al. ..... 427/447
2,774,625 A 12/1956 Hawley et al.
3,111,267 A 11/1963 Shepard et al.
3,159,348 A 12/1964 Wedan
3,627,204 A 12/1971 Stand
3,655,425 A 4/1972 Longo et al.
3,676,638 A 7/1972 Stand
4,004,735 A 1/1977 Zverev et al.
4,231,518 A 11/1980 Zverev et al.
4,290,555 A 9/1981 Suwa et al.
4,370,538 A 1/1983 Browning
4,598,871 A 7/1986 Hartle
4,632,309 A * 12/1986 Reimer ..... 239/8
4,688,722 A 8/1987 Dellassio et al.
4,694,990 A 9/1987 Karlsson et al.
4,819,879 A 4/1989 Sharpless et al.
4,836,448 A * 6/1989 Spaulding et al. ..... 239/79
4,863,316 A * 9/1989 Gianella et al. ..... 406/14
4,911,363 A 3/1990 Webber
5,041,713 A 8/1991 Weidman
5,135,166 A * 8/1992 Dietiker et al. ..... 239/8
5,148,986 A * 9/1992 Rusch ..... 239/85
5,262,206 A 11/1993 Rangaswamy et al.
5,285,967 A 2/1994 Weidman
5,408,066 A 4/1995 Trapani et al.
5,844,192 A 12/1998 Wright et al.
5,932,293 A 8/1999 Belashchenko et al.

(Continued)

FOREIGN PATENT DOCUMENTS

GB 1026305 4/1966

*Primary Examiner*—Eric Keasel
*Assistant Examiner*—Jason Boeckmann
(74) *Attorney, Agent, or Firm*—Dilworth & Barrese, LLP

(57) ABSTRACT

A system for thermal spray coating of a particulate material onto a substrate includes a spray gun apparatus having dual vortex chambers for the mixing of fuel gas and oxygen. The apparatus provides a jet flame resulting from a compression wave formed by compressed air. Dual venturis control the flow of fluidized coating material particles to provide smooth and controlled delivery of coating material to the spray gun.

17 Claims, 14 Drawing Sheets

U.S. PATENT DOCUMENTS

| | | | | |
|---|---|---|---|---|
| 6,003,788 | A | 12/1999 | Sedov | |
| 6,076,742 | A * | 6/2000 | Benary | 239/84 |
| 2002/0125349 | A1 | 9/2002 | Michael | |
| 2003/0071143 | A1 | 4/2003 | Mauchle | |
| 2003/0080220 | A1 | 5/2003 | Mather et al. | |
| 2003/0094519 | A1 | 5/2003 | van der Steur | |
| 2005/0073107 | A1 * | 4/2005 | Aram | 277/434 |

* cited by examiner

APPARATUS FOR THERMAL SPRAY COATING

CROSS-REFERENCE TO RELATED APPLICATIONS

This application claims priority to U.S. provisional application Ser. No. 60/509,948 filed Oct. 9, 2003, which is herein incorporated by reference.

BACKGROUND

1. Field of the Invention

The present invention is directed to apparatus for thermal spray coating, and particularly to a portable thermal spray coating gun for applying a polymer-containing coating material to a substrate.

2. Background of the Art

The term "thermal spraying" refers to process in which a coating material feedstock is heated and propelled as individual droplets or particles onto the surface of a substrate. The coating material is heated by the applicator (e.g., a thermal spray gun) by using combustible gas or an electric arc and converted into molten or plastic droplets or particles, which are propelled out of the spray gun by compressed gas. When the coating material particles strike the substrate they flatten and form thin platelets ("splats") that adhere to the surface of the substrate. The splats cool and build up a layer of applied coating material having a laminar structure.

Various types of thermal spray guns are known. For example, U.S. Pat. No. 5,285,967 to Weidman discloses a high velocity oxygen-fuel ("HVOF") thermal spray gun for spraying a melted powder composition of, for example, thermoplastic compounds, thermoplastic/metallic composites, or thermoplastic/ceramic composites onto a substrate to form a coating thereon. The gun includes an HVOF flame generator for providing an HVOF gas stream to a fluid cooled nozzle. A portion of the gas stream is diverted for preheating the powder, with the preheated powder being injected into the main gas stream at a downstream location within the nozzle. Forced air and vacuum sources are provided in a shroud circumscribing the nozzle for cooling the melted powder in flight before deposition onto the substrate.

Thermal spray guns typically use mixtures of oxygen-fuel gas, air-fuel gas, air-liquid fuel, oxygen-liquid fuel, or electric arc, and plasma as a heat medium to melt and propel the individual droplets to a prepared substrate. Thermal spray devices fall within general classification of equipment: (1) wire combustion, (2) powder combustion, (3) twin wire electric arc, (4) plasma-powder, (5) high velocity oxygen-fuel gas-powder, (6) high velocity oxygen-fuel gas-wire, (7) high velocity air-liquid fuel-powder, (8) high velocity oxygen-liquid fuel-powder, (9) detonation gun powder, and (10) water cannon plasma. In general thermal spray devices are wire combustion, powder combustion, plasma and electric arc.

In the wire combustion process a combustion heat source is initiated and feed stock material in wire or rod form is driven into the heat medium where a compressed air stream concentrates the heat source about the axially fed feed stock whereby it is melted atomized and propelled to the substrate for deposition of the coating.

Attempts have been made to spray polymer materials in wire form using existing wire combustion technology; however, they have not succeeded as the air compression wave required to atomize the polymer wire is oriented so as to impinge the high temperature flame directly onto the feedstock material and thereby consuming the resultant atomized droplets. The high temperature associated with this device can cause embrittlement of the coating. The existing wire combustion technology uses a siphon plug to mix the oxygen and fuel gas prior to combustion. This is a complicated and expensive component to machine.

In the powder combustion process a combustion heat source is initiated and feed stock material in powder form is introduced axially or tangentially to the propagated flame. The feedstock powder material is delivered by means of a powder feeder or gun mounted hopper.

The powder combustion process has been used to apply polymer materials; however, the flame temperature consumes 50 percent or more of the feedstock material. Additionally, the relatively high temperature can burn the subsequent applied coating and/or cause embrittlement of the coating. The existing powder combustion technology uses a siphon plug to mix the oxygen and fuel gas prior to combustion. This is a complicated and expensive component to machine. Combustion powder equipment does not provide for the generation of an aligned and oriented compression wave nor does it provide for cooling mixture air in the nozzle body whereby the flame temperature can be lowered.

In the electric arc process two feed stock wires of similar or dissimilar material with opposite polarity are fed into a spray device where they are directed to impinge one upon the other and thereby strike an arc producing rapid melting of the feed stock materials. A concentrated compressed air stream atomizes the molten material and propels it to a substrate. The generating source for the electric arc is a MIG welding rectifier where the positive charge is applied to one feedstock material wire and the negative or ground is applied to the other feedstock material wire.

The electric arc requires material in wire form which must be electrically conductive and therefore is not suitable as a means of spraying plastic materials.

In the plasma powder system a heat source is generate by passing an inert gas between the gap formed by an electrode and nozzle which are at an electrical potential. A high voltage, high frequency, low amperage arc is struck which bridges the gap between the electrode and nozzle. This small amperage arc partially ionizes the inert gas and generates a conductive path for the low voltage, high amperage potential to complete a circuit. The inert gas is thereby totally disassociated expands and exits the nozzle bore at high velocity. During the recombination of the disassociated gas heat is generated which is used to melt the feedstock material powder injected into the plasma flame tangentially. The velocity of the flame propels the feedstock material powder onto a substrate.

The plasma gun has been used to spray high temperature polyester with an aluminum constituent component but the intent is to burn off some of the polymer material. The operating cost of the equipment further limit it as a device for economical on-site application of powder paint materials.

In the detonation gun system a heat source in propagated by a series of controlled explosions. An oxygen-fuel gas mixture is injected into a chamber by a means similar to the valve in an internal combustion engine. However, the chamber is open at one end and there is no piston. The oxygen-fuel gas mixture is ignited by a spark plug which is coordinated with the valve train. The fuel and ignition cycle is repeated multiple times per second and the resultant detonation wave melts and propels the feedstock material to a substrate. The feedstock material is delivered in powder form from a powder feeder device.

The detonation gun is large and requires a dedicated room. It cannot be used on site. It is used to apply hard dense coatings and is not suitable for polymer materials.

High velocity is unsuitable for applying polymer materials in that the pressures required for the fuel and oxidizing medium gases ensure a large flame and high temperature. Also, the very high velocity is detrimental to the plastic droplets. The temperature of the flame can degrade and embrittle the applied coating. Further, the high operating cost of the equipment precludes it from ever becoming a viable means of applying low cost polymer materials.

Powder feeders come in a variety of constructs; but, the basic function is to convey material in powder form. These constructs are fluidized bed with venturi delivery, mechanical screw with venturi delivery, gravity fed with venturi delivery, meter wheel with venturi delivery. Powder feeders are required to deliver feedstock materials in powder form, to various equipments, from a material source which, is detached from the said equipment. This equipment can be a thermal spray device, electrostatic powder paint gun, extrusion screw and injection molding equipment. In all cases a feeder which delivers precisely metered and non pulsed material is essential. This is particularly true for thermal spray powder combustion equipment and electrostatic spray guns.

Current fluid bed venturi powder feeder technology is insufficient for use in thermal spray devices and electrostatic powder paint guns. In both electrostatic and thermal spray equipment the pressure, velocity and flow required at the nozzle to deliver the feedstock material to the substrate, is different than the pressure, velocity and flow required to generate a vacuum and meter feedstock material (spray rate). Currently used equipment uses the same pressure, velocity and flow source for both meter and delivery functions. This is a compromise of two separate functions. The mechanical screw/venturi and the meter wheel venturi separate the functions but they are subject to binding, wear, and pulsing from uneven feed into the wheel or screw.

Powder paint equipment delivers polymer/powder paint materials to a substrate via an electrostatic spray gun. This gun applies an electrical charge to the feedstock material which is at a different charge to the substrate to be coated. The coated part is placed in an oven whereby the electrically attached polymer materials are melted and cured. In a second embodiment of this technology the substrate to be coated is placed in an oven and heated above the melting point of the polymer material to be applied. The heated part is then dipped into a fluidized bed of the feedstock polymer powder whereby the material in contact with the heated part melts and is deposited onto the substrate.

Both embodiments have limitations to their use. They require high energy cost to operate the oven. They cannot be used on site as they are factory fixed facilities. The parts that can be coated are limited by the size of the oven available. In the case of the electrostatic equipment certain combinations of metals and or conductive polymers may be precluded as it can affect the charge.

As stated previously, existing thermal spray technology has been used in an attempt to apply thermally sprayed polymer materials in powder form with very limited success. Additionally, equipment has been produced that is dedicated to the application of polymer powder materials. The heat sources for these apparatus are oxygen-fuel gas or propane-air. They function like typical thermal spray powder combustion guns. However, they address the temperature requirements of polymer material somewhat better than higher temperature thermal spray combustion powder apparatus designed for metal and ceramic materials.

There are limitations to the effectiveness of these apparatus. They do not address the separate function requirements of particle velocity and flow in the heat medium and the pressure and flow required to supply a measured spray rate consistent with the thermal output of the gun. They either supply the correct spray rate for the material utilized and the thermal output or they provide a correct velocity and flow to effect an appropriate dwell time or they compromise on both. Furthermore, all prior embodiments of these apparatus use a siphon plug gas mixing device. In the case of the propane-air heat source the function of the stoichiometry of the flame is not separated from the air used to provide for the correct velocity and flow of the feed stock materials. As additional air is introduced into the flame to propel the particle the temperature of the flame is raised as the proper mix of propane and oxygen is attained. In all prior known embodiments of the apparatus the temperature of the flame is too high as they do not address the requirement of cooling the flame before it contacts the polymer feedstock materials. This high temperature results in polymer feedstock materials combusting or acting as an additional fuel source when in contact with the flame. It is indicated by the bright orange flame generated when polymer materials are introduced into the heat medium. This combustion of the feedstock materials results in reduced deposition rates below 50%. Additionally, it precludes the use of electrostatic grade (the 5 to 160 micron range) materials which provide for a more homogenous and smoother coating. This limits the equipment generally to fluidized bed materials which, are in the 80 to 200 micron range and deliver rougher coatings. As the temperature of existing apparatus is too high they do not address the need for a compression wave to effect efficient transfer of a reduced temperature heat source to the polymer material feedstock. The prior embodiments rely on preheating the substrate to 400° F. prior to application of the polymer feedstock material to achieve a viable deposited coating. All technology up to now has failed to address the importance of alignment of cooling air or compression jets with the nozzle gas jets. Finally, the prior known apparatus are limited in the range of and control of the spray parameters.

While various apparatus are known, there is yet an apparent need for improved apparatus. These improvements include: better control of the heat source medium, improved material delivery for the separation of functions of material velocity and flow in the heat source and the material meter (spray rate) function, the elimination of a siphon plug mixing device, the ability to cool the flame temperature prior to contact with the polymer feed stock material, the generation of a compression wave for the efficient transfer of a reduced temperature heat source to the polymer feedstock materials, the need for alignment of the cooling mixture air with the nozzle flame jets, the need for the alignment of the compression wave jets with the nozzle flame jets, the ability to spray lower micron electrostatic grade materials (5 to 160 microns) for improved coating homogeneity and smoothness, the ability to apply polymer coatings with little or no need for pre-heating the substrate, the ability to apply polymer materials without consuming the same as a fuel source, the ability to achieve near 100% deposit efficiency of the polymer coating, the ability for non destruction or degradation of the applied polymer coatings by the thermal spray device as the coating is being applied, and the ability to have a greater range and control of the spray parameters.

SUMMARY

The present invention is directed to a novel apparatus for thermally applied plastic and powder paint coatings, and particularly to a portable thermal spray coating gun for applying polymer coating materials to a substrate. The material is in powder or wire form and encompasses all generally known thermoplastic and thermoset polymeric powder paint materials, i.e., epoxies, urethanes, nylons, polyesters, polyethylene, polypropylene, polyethers, acrylics, vinyls, PVC's, fluorocarbon polymers, silicones, hybrids and numerous combinations of the included materials. In general all polymer materials in powder form between 5 microns and 500 microns are usable in the described device. Also, all polymer materials which are or can be drawn into a wire are useable in the described device. The materials in powder or wire form can have included other organic polymer materials or non organic mineral or metal materials such as ceramics, silica, graphite, carbon, and all metals in powder form. The metal materials can take the form of copper, brass, bronze, tungsten and chrome carbides, stainless steels, aluminum, zinc, zinc/aluminum, iron and all single component metals and composites available for the general thermal spray industry. Biocides, anti-fouling agents and lubricious materials can also be include into the plastic polymer matrix.

BRIEF DESCRIPTION OF THE DRAWINGS

Various embodiments are described below with reference to the drawings wherein.

DETAILED DESCRIPTION OF PREFERRED EMBODIMENT(S)

Figure 1:
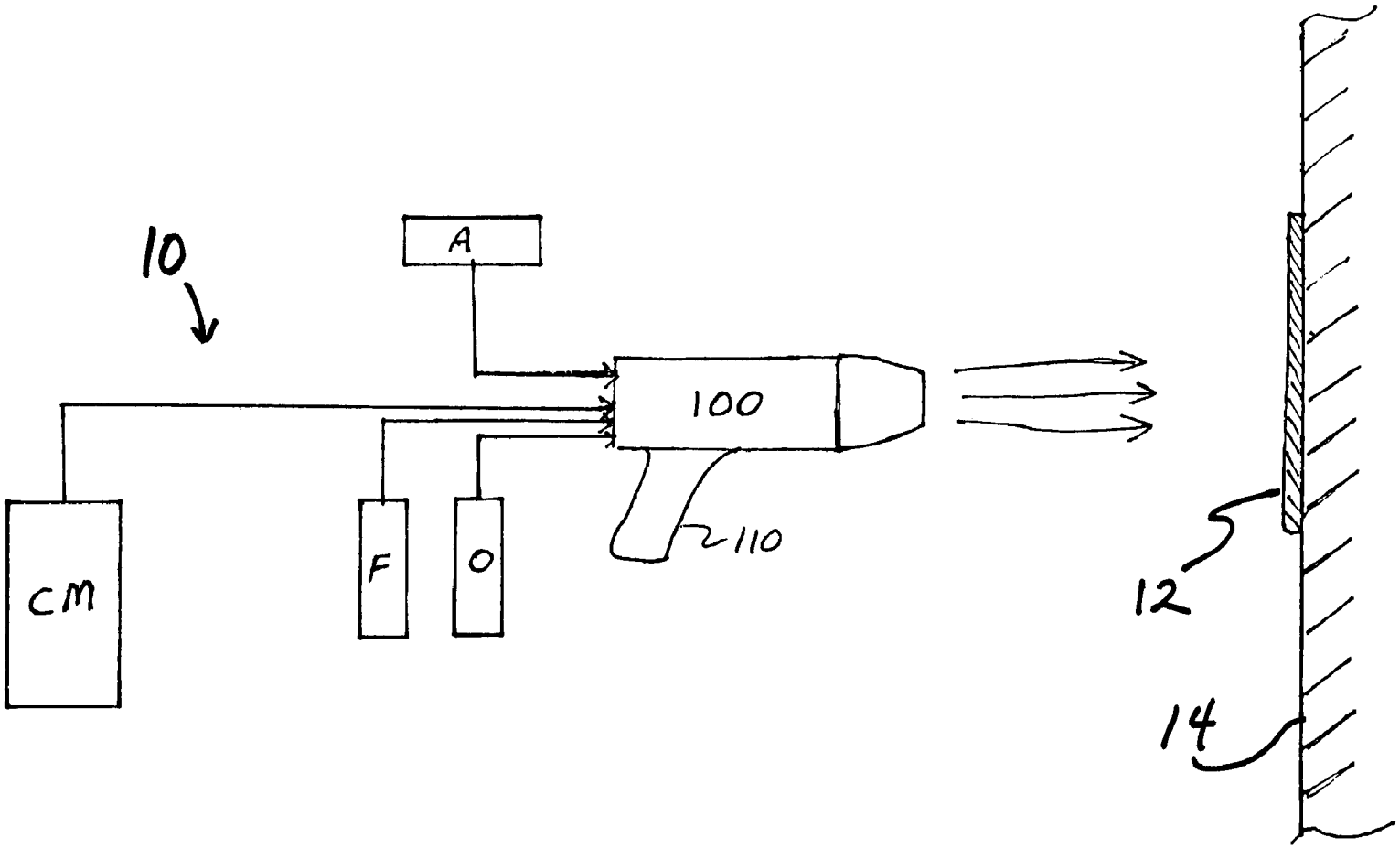
FIGS. 1 and 2 are diagrammatic illustrations of the system of the invention.

The present invention employs a vortex fuel-oxygen mixer and other innovations to provide a portable flame thermal spray gun with up to 100% efficiency in coating material deposition. It is simple and convenient to use at on-site locations and gives the user great flexibility in applying, for example, solid, smooth surface coatings, or porous, or rough surface coatings, for any particular polymer coating material of any desired thickness.

The thermally applied polymer and powder paint spray system consists of a spray gun with unique embodiments including a novel and unique powder feeder and regulated and controlled supply of air, oxygen, and propane. Polymer material to be applied is placed in the powder feeder whereby the material feed rate is controlled by a feed rate venturi and directed within the feeder to a material delivery venturi whereby the feedstock material to be applied is directed to the spray gun where it is melted and propelled to a substrate for application. The control of the powder feeder is determined by the regulated pressure and flow of air to a fluidizing chamber, material feed rate venturi and a material delivery venturi. The gun is controlled by the material rate supplied from the powder feeder and by the independent delivery velocity and flow of the material rate. Additionally, the gun is provided with a pressure and flow regulated supply of oxygen and propane for use as a combustion heat source. A pressure and flow regulated supply of air is directed to unique jets in the gun nozzle which, serve to provide a curtain between the low temperature melting feedstock material polymers and the combustion flame and also to cool the combustion flame. The same air is directed to compression jets which are aligned with the nozzle air jets so that the cooled combustion flame is impinged on the feedstock material. These jets form a compression wave. The compression wave produced in this process allows for the rapid transfer of the heat medium to the thermal plastic polymer material to be melted. This compression wave is analogous to a pressure cooker. However, it is an open rather than a closed system. The compression wave is focused about an axis formed by the polymer wire or powder and has a forward momentum away from the chamber. This system allows for the rapid melting of feedstock materials without burning or degrading the delicate materials.

The apparatus includes a double vortex which is propagated by the injection of oxygen and propane at the same point, but in opposing direction, whereby the oxygen and propane premix, and the oxygen rich vortex moves in a counterclockwise direction and the propane rich vortex moves in a clockwise direction within the first stage chamber formed by the diffuser ring body and the gun body. The double vortex moves in opposite direction 180 degrees from point of injection and enters to opposing ports. Upon entering these ports the oxygen rich vortex and the propane rich vortex are directed to intersect and complete the mixing of the combustion gases in the second stage chamber which is formed by the diffuser body and the nozzle stem. The combined combustion gases then pass through the annular gap formed by the nozzle stem and the diffuser whereby they enter a chamber formed by the back of the nozzle body, the face of the diffuser, the nozzle stem and the gun body. The gas then exits the nozzle via the nozzle gas discharge ports whereby a combustion flame is propagated. This method of gas mixing is new, novel, and unique. It is simple, easy to machine, and eliminates the complicated siphon plug assembly found in all other combustion thermal spray apparatus. As there are dual chambers and a double vortex it mitigates backfire as it is difficult for maintained combustion to occur in a vortex and especially where the gases pass through the ports from the first chamber to the second chamber as the velocity is increased so that the rate of supply is greater then the rate of combustion. Thus this method is inherently safe.

The apparatus includes alignment pins which permit the precise orientation of the compression jets with the flame jets and the flame cooling nozzle air jets. In one embodiment the compression jets in the air cap body are aligned along the radius lines of the air cap body with the flame cooling jets in the nozzle and along the radius lines therein. This permits cooled combustion gases to impinge and compress upon the feedstock material. In another embodiment of the apparatus the compression jets are aligned along the radii form by the flame jets in the nozzle and the compression jets in the air distributor cap. This embodiment permits higher temperature hot gases to impinge on the feedstock material, but in all other ways it is similar in operation and function as to that describe immediately above. The orientation of the compression jets in the air distributor cap with respect to the nozzle flame jets or cooling nozzle air jets is by means of an aligning pin which embedded in the gun body and passes through the diffuser and into the nozzle body whereby the nozzle is fixed into place with its cooling jets and flame jets oriented and fixed with respect to the gun body. There is a second aligning pin in the gun body which permits the alignment of the air distributor cap. The air distributor cap preferably has two aligned holes which permit the orientation of the compression jets to be aligned with either the cooling air jets in the nozzle or the flame jets in the nozzle. No known thermal spray device incorporates this alignment feature. This is unique and novel and new. It is very important in ensuring that set parameters do not change with arbitrary alignment of gun components. Further, no known powder combustion thermal spray apparatus uses compression wave jets to effect a rapid transfer of heat to the powder feedstock material. The apparatus of the present invention not only compresses the hot flame gases but also provides cooling air jets which act as a curtain between the hot flame and the low melting point polymer coating material.

The apparatus includes new, unique, and novel flame cooling nozzle air jets. These jets are in the nozzle midway between subsequent flame jets and are concentrically closer than the flame jets to the discharge port for the material feedstock. This arrangement provides a curtain of air between the flame jets and the coating material such that the coating material does not come into direct contact with the high temperature combustion gases of the flame jets. This embodiment permits the hot gases from the flame jets to be cooled prior to contact with the materials feedstock. There are no known thermal spray apparatus which incorporate this feature.

The independent control of the oxygen-containing stream used for oxidation of the fuel gas and the air stream used for the nozzle cooling avoids the disadvantage of having a single air stream source used for both oxidation and material cooling. That is, if the same air stream is used both for fuel gas oxidation and material cooling, increasing the air flow sufficiently for cooling may result in a stoichiometric excess of air which extinguishes the fuel gas flame. On the other hand keeping the air flow within the air/fuel ratio flammability limit may result in insufficient cooling of the coating material. This, in turn, can result in overheating and charring low melting point polymers, thereby precluing their use as coating materials. The apparatus and system of this invention avoid this problem.

The apparatus provides for the independent control of the velocity and flow of the feedstock material into the heat source at the front of the gun by way of the nozzle material discharge port. This independent delivery is essential for all powder thermal spray apparatus but particularly for low melting point combustible polymer feedstock materials. Polymer feedstock materials are combustible in powder form. They can act as an additional fuel source when they come into contact with the flame. For at least this reason at a minimum the velocity of the supply must be greater than the rate of combustion of the feedstock material for the feed rate desired. However, the dwell time of coating material in the heating zone must be sufficient for the transfer of the heat medium to the feedstock material so that all particles are appropriately melted. There are no known existing thermal spray apparatus which provide for the independence of this essential function. All existing powder combustion thermal spray devices use the same velocity and flow to establish a spray rate and deliver it to the front of the spray gun into the heat medium. The required spray rate and the required velocity and dwell time are two non coincident functions which must be separate. Our embodiment provides for this by means of a new, unique and novel special powder feeder.

The apparatus includes a new, unique, and novel powder feeder as discussed above. This fluidized bed powder feeder permits the separation of the functions of material feed rate and material velocity and flow into the heat medium. This is accomplished by a unique combination of two venturi generators as opposed to one. The first is the material feed rate venturi which is adjusted to control the rate at which feedstock material is delivered to the second venturi in an open coupling. The open coupling permits the second venturi to draw a vacuum and provide a flow of a desired velocity and flow independent of the first venturi. When material flow is not called for the second venturi functions continuously. The continuous velocity and flow is matched for the delivery and dwell time required at the front of the gun for the feedstock material to be sprayed. This continuous velocity and flow ensures that the material feed hose does not collect material feedstock powder at the bends in the hose, which causes back pressure and surging. When material is called for, the first venturi siphons powder from the powder feeder hopper and injects the desired rate into the vacuum port of the second venturi. The flow and velocity of the first venturi is always lower than that of the second. There is no chance of back pressure in the material feed hose. There is no surging and a very accurate non pulsing material stream is delivered to the heat medium. All other existing fluidized bed venturi powder feeder apparatus rely on one venturi to deliver a measured rate of feedstock material to a thermal spray device, electrostatic powder spray gun, injection molding machines, extrusion machines or bulk material process delivery. As such, the velocity and flow of the transport air or gas medium is determined by the rate at which material is desired to be delivered to a particular apparatus. The single venturi concept is plagued by pulsing, surging, stoppage and non uniform rate of delivery of the desired material. The reason for this is that as material is siphoned and injected into the material feedstock delivery hose the presence of the material and accumulation thereof creates a back pressure which inhibits the flow of air into the venturi and which decreases the vacuum. Material in the hose must flow out from a diminished flow before the vacuum is reestablished and new material is delivered. This cycle repeats itself and material flow is always varying from too much to very little or none.

While the features described above are new, unique, and novel in and of themselves, the synergistic relationship of all of them working together provides an apparatus truly able to apply polymer and powder paint feedstock materials efficiently, at near 100% deposit efficiency, without degrading the feedstock material, applied coating or the substrate.

Referring now to FIG. 1, a coating application system 10 is shown for applying a coating material using the thermal spray gun of the present invention. Coating application system 10 includes a portable thermal spray gun 100, to which is connected a supply of compressed air stream A, fuel gas F such as methane, ethane, propane, butane, acetylene, etc., a supply of oxygen O, and a supply of coating material CM. Spray gun 100 preferably includes a handle grip 110 to facilitate manual use thereof. As used herein, the term "oxygen" includes both pure oxygen and oxygen-containing gas mixtures having an oxygen content at least as high as that of air. The coating material is in the form of a powder having a particle size of preferably from about 5 to about 500 microns. When the system is in operation the coating material powder is fluidized by a stream of air, and both air and coating material particles are supplied to the thermal spray gun 100 for applying a coating 12 to the surface of a substrate 14.

The coating material can be any thermoplastic polymeric material which can be melted without significant degradation. Such thermopolymers include, but are not limited to, polyethylene (low and high density), polypropylene (low and high density), polyurethane (low and high density), nylon (e.g., nylon 6, nylon 11), nylon copolymers, EVA, EEA, ABS, PVC, PEEK, PVDF, PTFE (e.g., Teflon®) and other fluorocarbon polymers, polycarbonate, acrylics, polyethers, polyesters, epoxy resins, silicones and chemical and/or physical combinations thereof. Additional components in the coating material can include metals (e.g., zinc, aluminum, zinc-aluminum alloy, ferrous metal alloys, copper and copper alloys, etc.) as a separate powder or as clad powder, ceramics, carbon, graphite, or functional components such as colorants, electrically conductive materials (e.g., for electromagnetic shielding), fluorescent or phosphorescent materials, anti-fouling agents, reflectant materials, radar absorbent materials, UV protectors, anti-microbials and the like.

The substrate 14 to which the coating material is applied can be porous or non-porous metal (e.g., steel, aluminum), wood, cork, glass, ceramic, solid or foamed polymeric material, paper-containing material, asphaltic material, plaster, cement, concrete, stone, or any other material capable of receiving a coating. Various applications for thermal spray coating include spray painting or coating of bridges, ships, aircraft, ground transport vehicles, buildings, highway or other type signs, road markings, various structures in marine environments such as docks or piers, and any other operation in which the spray application of a polymer-containing coating material is suitable.

All of the supply inputs for A, F, O, and CM have means for individually regulating the flow rates and/or pressure to allow the thermal spray gun operator to make adjustments. Variation of the individual flow rates and/or variation of the flight distance of the coating material between the thermal spray gun exit and the surface of the substrate to be coated can produce smooth surface coatings, or rough surface coatings, or a variety of different physical coating features as desired.

Figure 2:
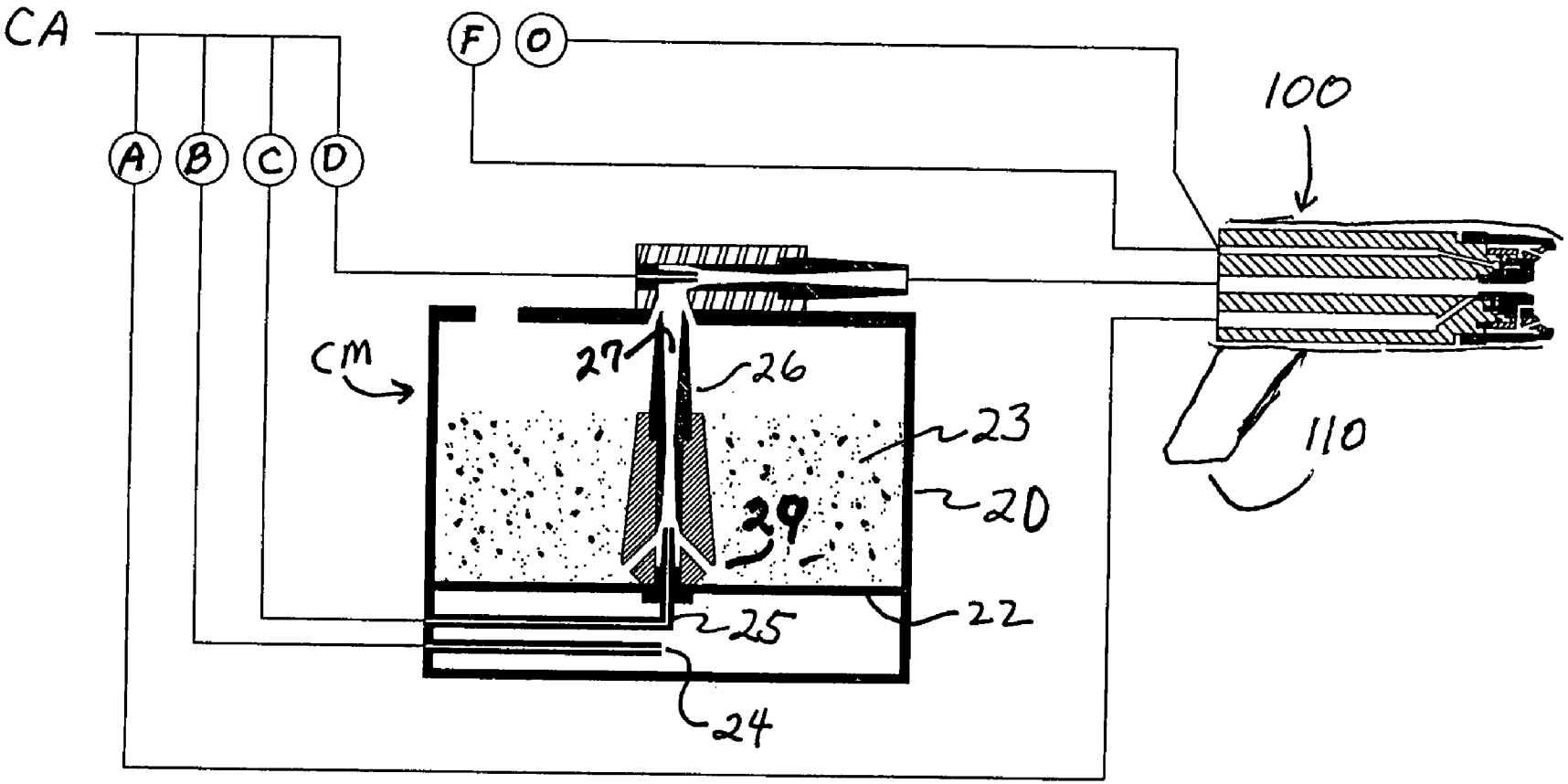
Figure 3:
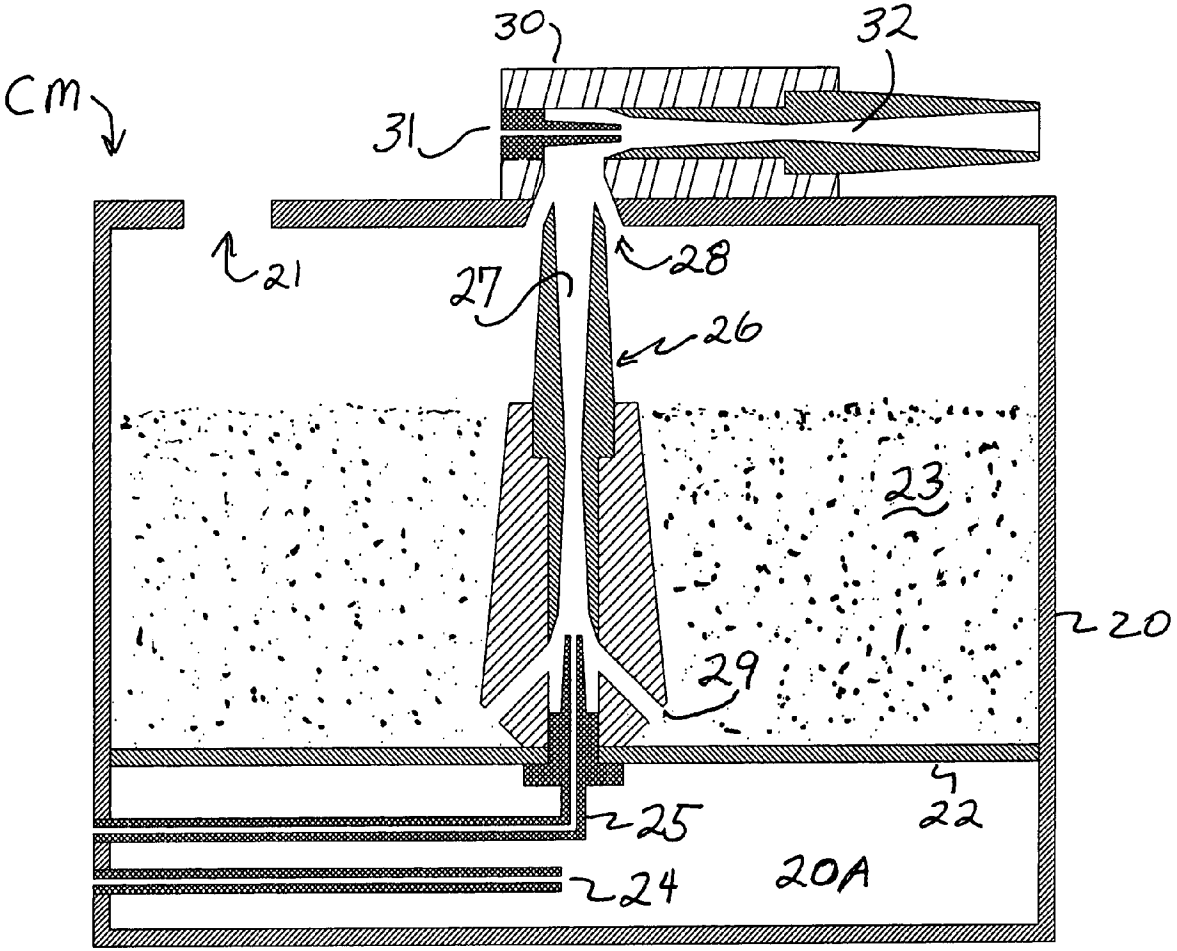
FIG. 3 is a diagrammatic illustration of the powder feeding system employing dual venturis.
Figure 4:
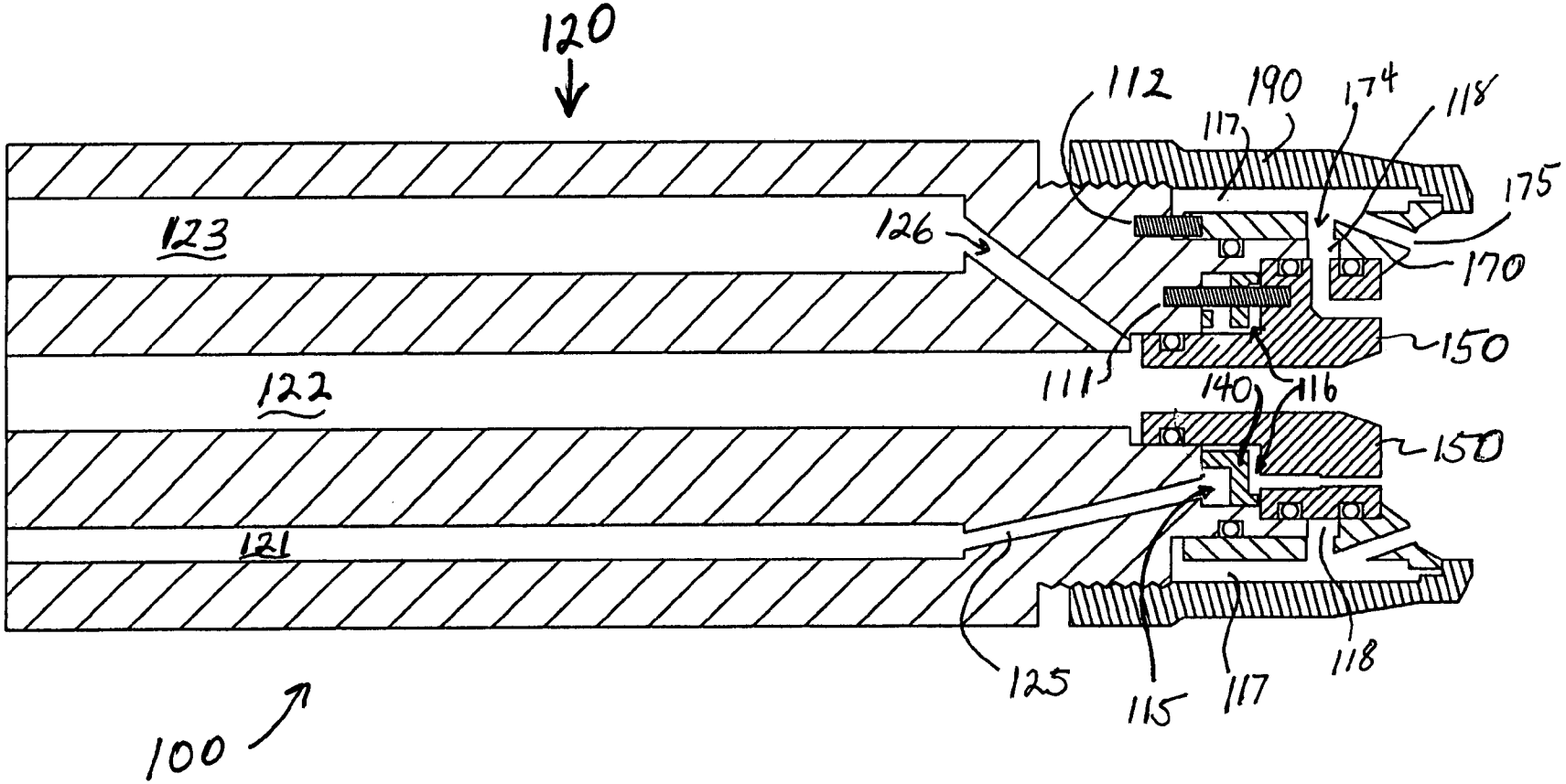
FIG. 4 is a sectional view illustrating the spray gun apparatus of the invention.
Figure 5:
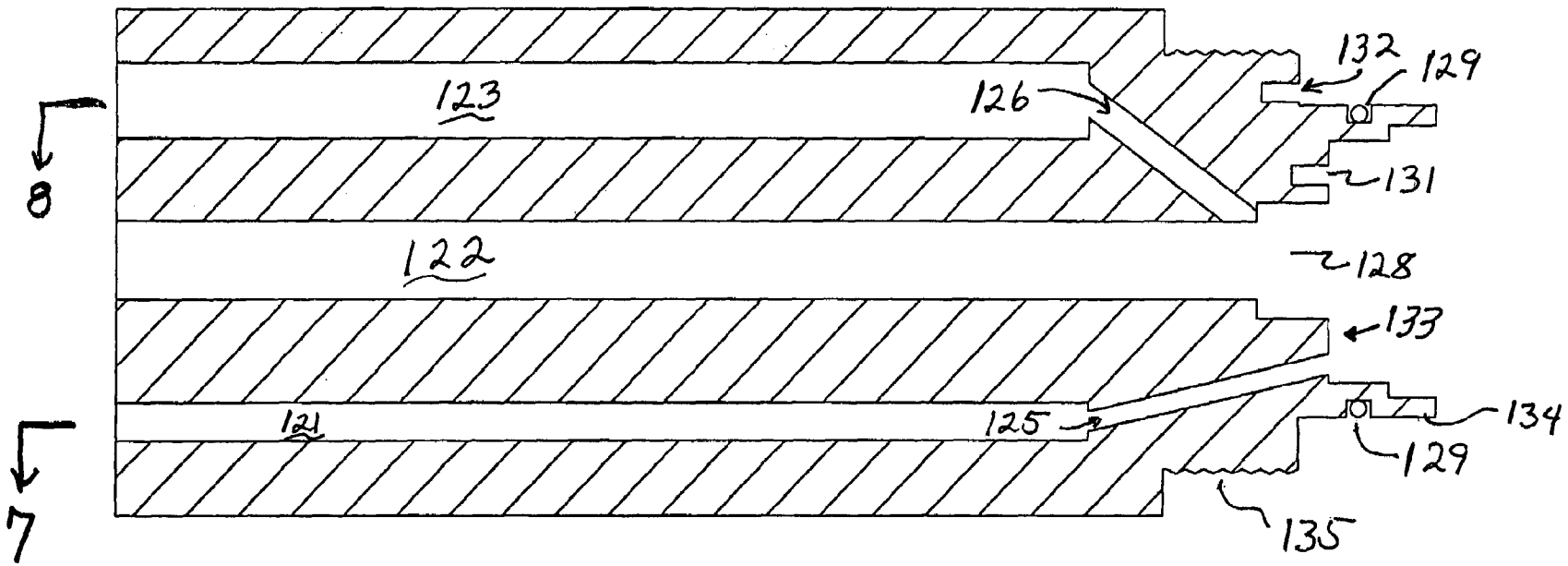
FIG. 5 is a sectional view illustrating the gun body.

Referring now to FIGS. 2 and 3, the coating application system includes a dual venturi system for controlling the feed of coating material from the coating material supply CM to the thermal spray gun 100. More particularly, air derived from a compressed air source CA is divided into individually controlled streams A, B, C and D. Stream A, as stated above, is connected directly to the thermal spray gun 100. Stream B is regulated fluidized bed air supply. Stream C is the regulated material feed rate air supply, Stream D is the regulated material delivering air supply.

Coating material supply CM includes a hopper 20 in which a bed of coating material particles 23 is contained and supported on a porous fluidized bed support plate 22. Compressed air from fluidized bed air supply stream B is directed through fluid bed air supply conduct 24 into a plenum below the support plate 22. The compressed air rises through support plate 22 and fluidizes the particulate bed 23.

Compressed air from stream C is directed through conduct 25 into a first venturi 26, and through axial channel 27 of the venturi. Fluidized coating material particles are drawn into channel 27 via inlet 29 and is directed into the second venturi 30. Port 21 serves to equalize pressure between the interior and exterior of hopper 20. Inlet 28 serves as a material siphon port and/or an air siphon port.

Compressed air from material delivery air stream D is directed into the air injection nozzle 31 of the second venturi 30. Coating material particulates discharged from the first venturi or air drawn through siphon port 28 are directed through axial channel 32 of the second venturi and are transported to the thermal spray gun 100, for example, through a flexible tubular conduct, pipe or other suitable means.

The use of separately controlled first and second venturis provides superior control of the coating process. Moreover the dual venturi system overcomes problems associated with single venturi systems, i.e., slow velocity, backup of material, and undesirable pulsating operation as opposed to smooth flow of material. It should be noted that the dual venturi system (FIGS. 2 and 3) for material delivery described above can be used for material supply to any dispensing apparatus or for any general purpose wherein a controlled supply of fluidized powder material is needed. Moreover, although the system is described herein with compressed air as the motive fluid, any compressed gas (e.g., nitrogen, inert gases such as helium or argon, oxygen, carbon dioxide, etc.) may be used in the dual venturi system described above depending upon what is appropriate for any desired purpose.

Referring now to FIGS. 4 to 8, the gun body 120 is an elongated member, preferably fabricated from aluminum alloy or any other suitable metal. Axial channel 122 is adapted to receive and direct a fluid stream of compressed air and coating particles distally toward the discharge end portion of the air gun 100. The oxygen stream is transmitted longitudinally and distally through oxygen supply channel 121, and then through oxygen delivery channel 125 which is angled toward outlet 136 at angle $\alpha$ relative to the axis X of the gun body. Fuel gas F is transmitted longitudinally through fuel gas supply channel 124 (FIG. 7) and then through fuel gas delivery channel 127 which is angled toward common oxygen-fuel gas outlet 136, preferably also at at angle $\alpha$ relative to the axis X of the gun body. Angle $\alpha$ preferably ranges from about 30° to about 80°, more preferably from about 40° to about 50°, although angles outside of these ranges may be used when deemed appropriate. Because of the angled orientation of the oxygen delivery channel 125 and fuel gas delivery channel 127, a dual vortex is formed in vortex gas mixing chamber 115 (FIG. 4) described below. The oxygen flows in one circular direction and the fuel gas flows in the opposite direction so as to provide vortex mixing of the oxygen and the fuel gas. Compressed air is transmitted longitudinally and distally through air supply channel 123, and then through air delivery channel 126, which subsequently forks into inclined passages **126*a* and 126*b* (FIG. 8) which terminate at distal surface 137** of the gun body.

The distal end of the gun body 120 includes a nozzle seat 128, which is a recess configured and dimensioned to receive the proximal portion of nozzle 150. Diffuser seat 133 is a recess configured and dimensioned to receive diffuser ring 140. Aperture 131 is configured and dimension to receive alignment pin 111, which maintains a stationary position of the diffuser ring 140 and the nozzle 150 when these components are mounted in their respective seats 133 and 128. Threaded portion 135 is adapted for screw-on attachment of an air cap body 190. The distal end portion of the gun body 120 also includes a generally cylindrical distally extending mounting surface 134 for mounting air distributor cap 170.

Figure 9B:
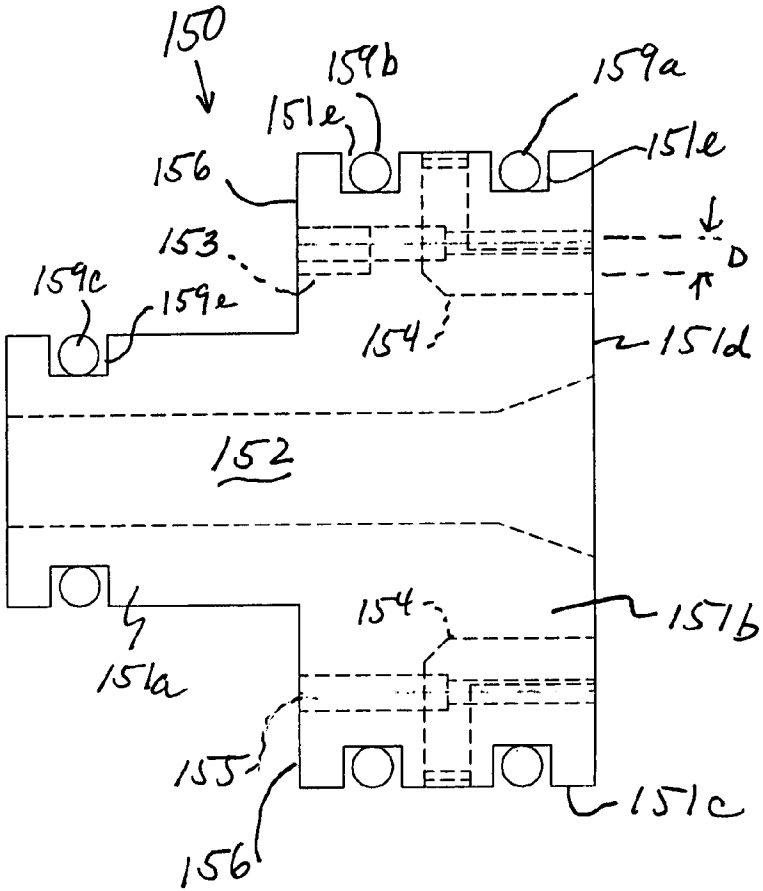
FIGS. 9A, 9B and 9C are respectively, an end view, side view and side sectional view of the nozzle.
Figure 9A:
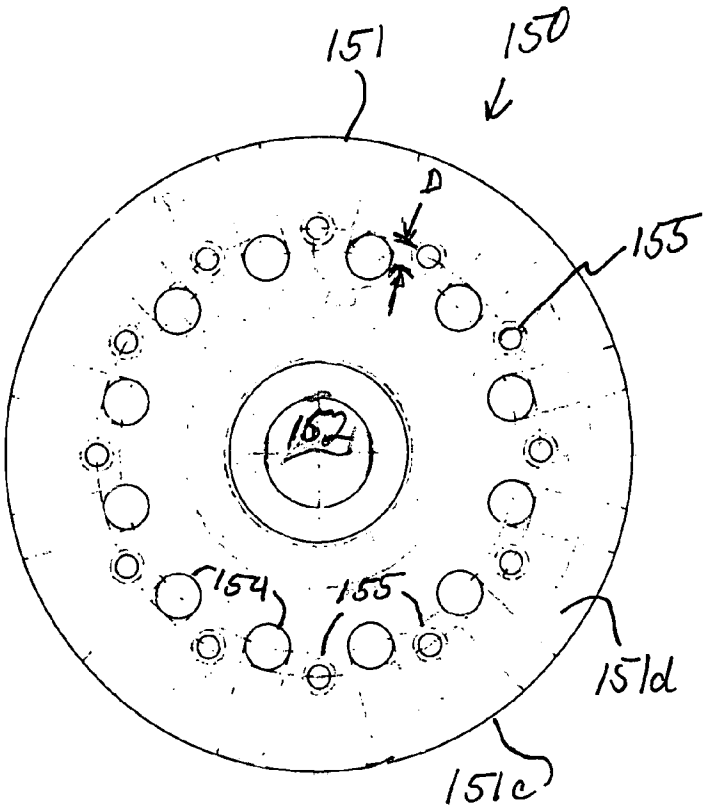
Figure 9C:
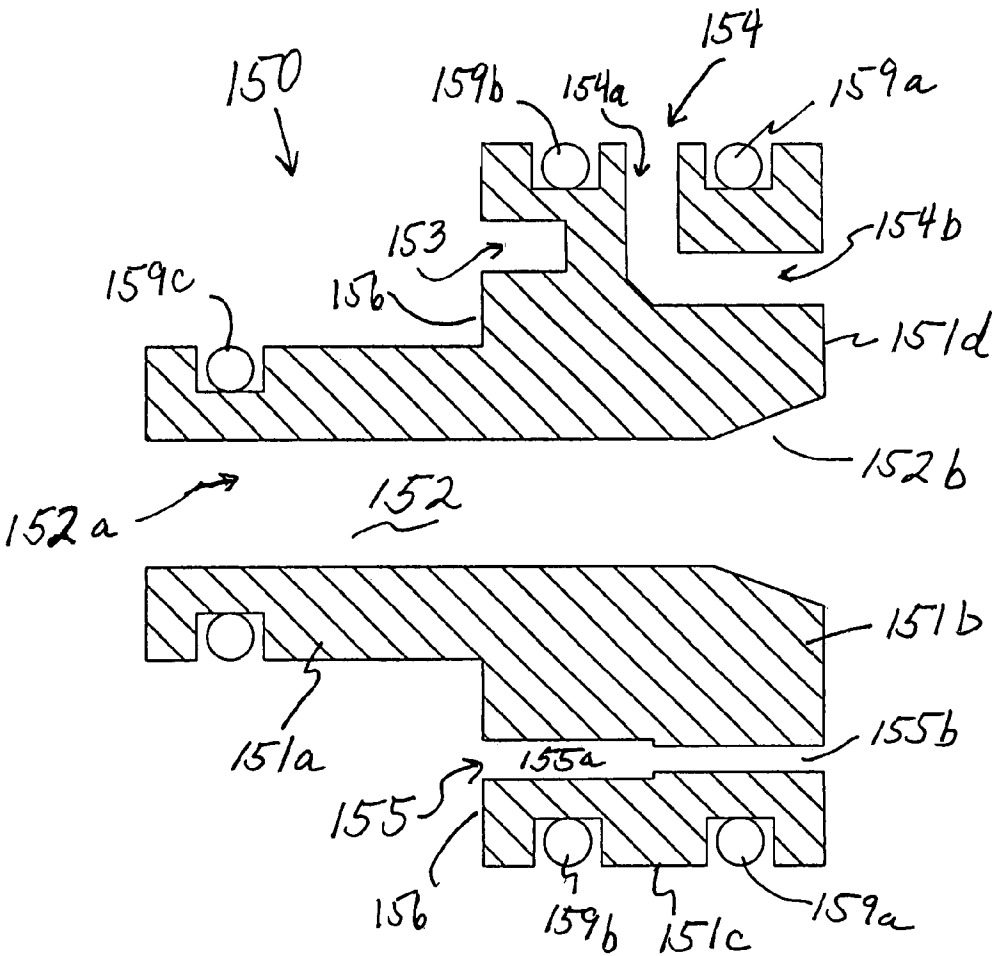

Referring now to FIGS. 9A, 9B and 9C, nozzle 150 comprises a generally cylindrical body having a proximal stem portion 151*a* and a distal flange portion 151*b*. Stem portion 151*a* is adapted to be received into nozzle seat 128 of the gun body. O-rings 159*a*, 159*b*, are seated in corresponding circumferential recesses 151*e* and extend circumferentially around the circumferential periphery 151*c* of the nozzle 150 to provide a gas seal and secure seating. O-ring 159*c* is positioned around the proximal end portion of stem 151*a*.

Nozzle 150 possesses an axial passageway 152 through which the fluidized coating material and carrier gas is moved. Passageway 152 includes a portion 152*a* having a constant diameter and a distal portion 152*b* which flares outward.

Flange portion 151*b* includes a plurality of passageways 155 oriented in a lengthwise direction (i.e. parallel to the axis) of the nozzle for passage therethrough of fuel gas and oxygen. Passageways 155 include proximal portions 155*a* having a relatively wider diameter cross section, and distal portions 155*b* having a relatively narrow diameter cross section.

Passageways 154 of the flange portion 151*b* are angled so as to have radial portion 154*a* and a lengthwise extending portion 154*b*. Passageways 154 admit air at the opening at the circumferential periphery 151*c* of the flange portion 151*b* and discharge air at the distal end surface 151*d* of the nozzle.

Recess 153 is adapted to receive alignment pin 111.

The unique configuration of nozzle 150 enables sufficient control of the flame, air and coating material flow to permit a curtain of air to protect the coating material particles from degradation by excess heat. Rather, enough heat is provided to melt the particles which are then projected onto the substrate surface.

Referring to FIGS. 9A and 9B, it can be seen that the distal outlets for passageways 155 and 154 are generally disposed around distal end surface 151*d* of the nozzle in respective concentric circular arrangements in an alternating, or staggered, pattern. However, the outlets for the air passageways 154 are concentrically closer to the coating material passageway 152 by a distance D, thereby providing a curtain of air interposed between the high temperature combustion gases of the oxygen-fuel gas flame and the coating material stream. Thus the coating material is heated sufficiently to cause melting but is not scorched, or degraded by the combustion flame jets. Distance D can be any distance suitable for the purposes described herein and can typically range from about 0.1 to about 5.0 mm, although distances outside of this range may be employed when appropriate.

Figure 10:
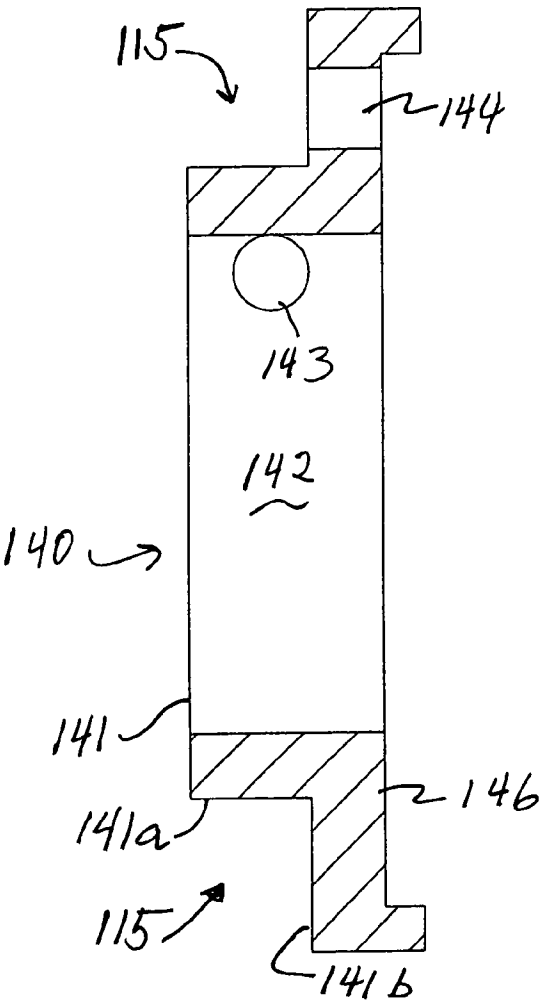
FIG. 10 is a side sectional view of the diffuser ring.

Referring now to FIG. 10, diffuser 140 includes a ring-shaped body 141 having an axial opening 142 through which the stem portion 151*a* of the nozzle is disposed. Circumferential wall 141*a* and proximally facing annular wall 141*b* together at least partially define a vortex gas mixing chamber 115 for the mixing of fuel gas and oxygen. Alignment aperture 144 is adapted to receive alignment pin 111 which is longitudinally disposed therethrough and thence into recess 153 of the nozzle as discussed above. Lateral opening 143 which admits fuel oxygen mixture from vortex gas mixing chamber 115 into a second vortex mixing chamber 116 (FIG. 4) at least partially defined by distal facing annular surface 146 of the diffuser ring (FIG. 10) and proximally facing surface 156 of the flange portion 151*b* of the nozzle (FIGS. 9B, 9C). As mentioned above, the double vortex mixing provided by the apparatus of the invention prevents backfire and provides stable operation of the gun as well as other benefits.

Figure 11:
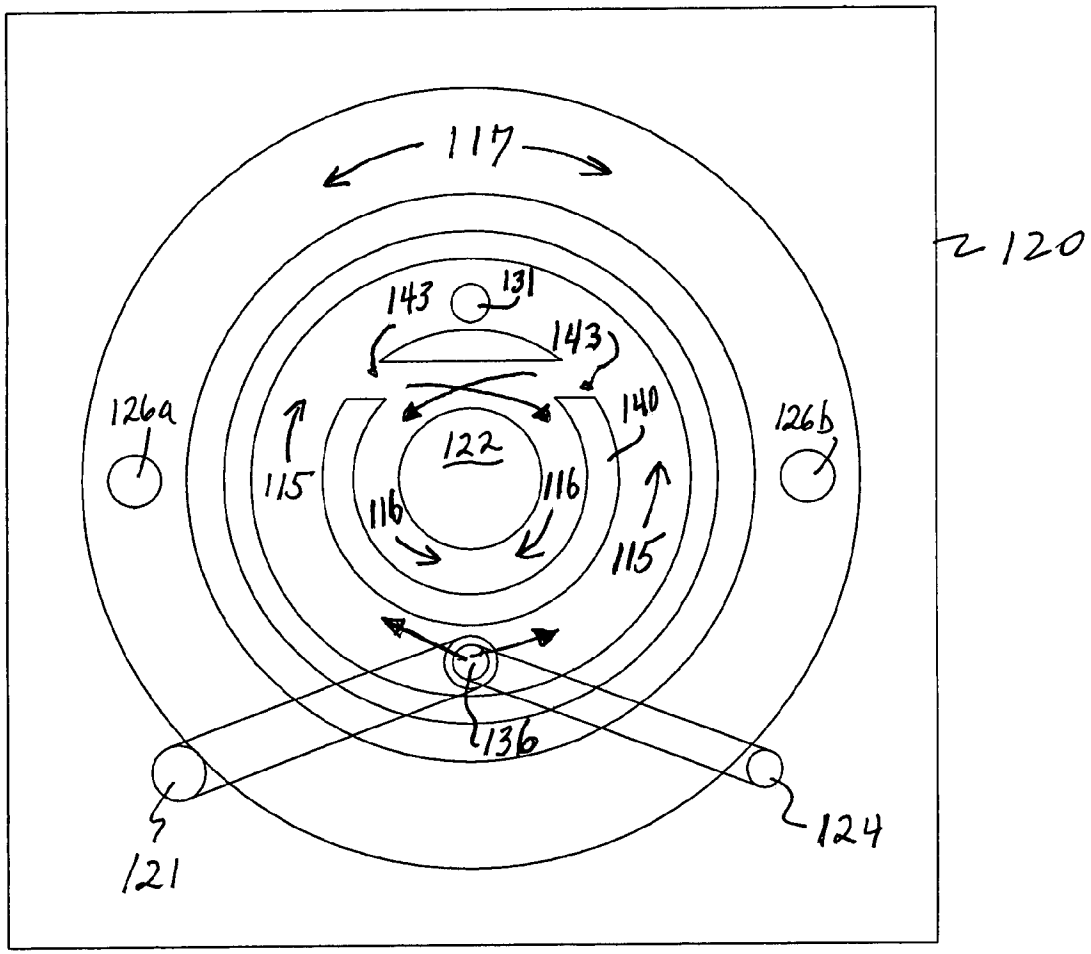
FIG. 11 is a diagrammatic end view of the spray gun apparatus.

Referring now to FIG. 11, a diagrammatic end view illustrates flow from oxygen supply channel 121 and fuel gas supply channel 124 exiting common outlet 136 and flowing through first vortex gas mixing chamber 115, then through lateral openings 143 in diffuser 140, and into second vortex gas mixing chamber 116, from which it enters and flows through fuel oxygen passages 155 of the nozzle 150.

Figure 12B:
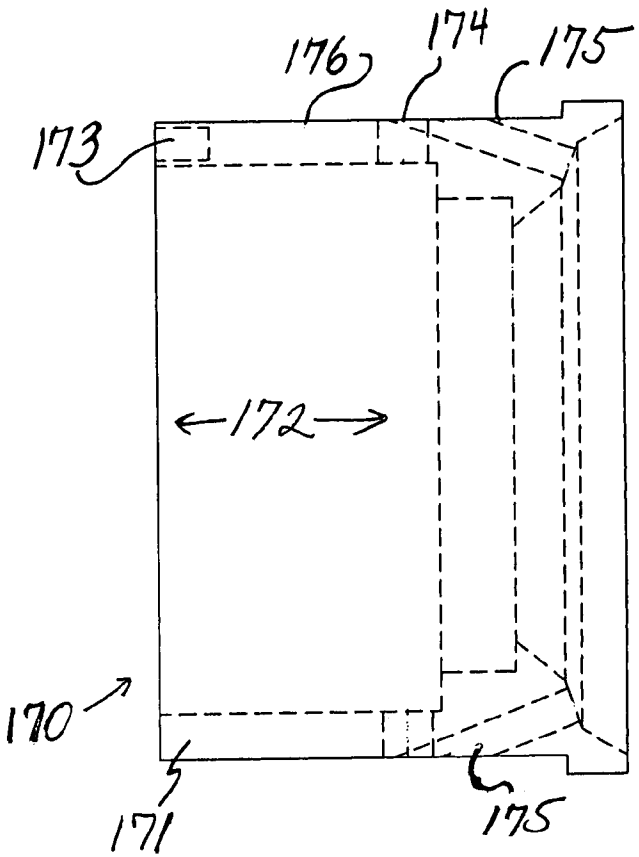
FIGS. 12A and 12B are respectively, an end view and a side view illustrating the air distributor cap; and, FIG. 13 is a side sectional view illustrating the air cap body.
Figure 12A:
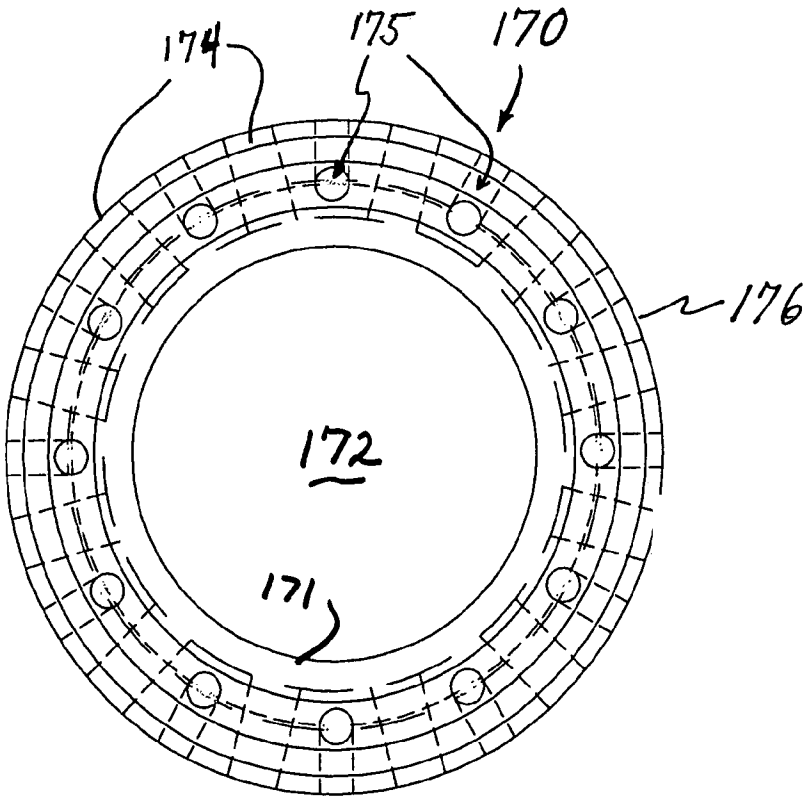

Referring now to FIGS. 12A and 12B, air distributor cap 170 includes a ring shaped body 171 and an axial passageway 172. Alignment pin 112 (FIG. 4) is received into recess 173 of the air distributor cap 170 (FIG. 12B) to align and secure the air distributor cap to the gun body 120. Air distributor cap includes a plurality of radial ports 174 to conduct air from a first annular air flow chamber 117 (FIGS. 4, 11) to a second annular air flow chamber 118 (FIG. 4) from which air is conducted into and through apertures 154 of the nozzle. Air enters the first air flow chamber 117 through air delivery channels 126*a* and 26*b* (FIG. 11). Air jet holes 175 are angled inward and provide a compression wave as compressed air is passed therethrough and injected into the flame.

Figure 6:
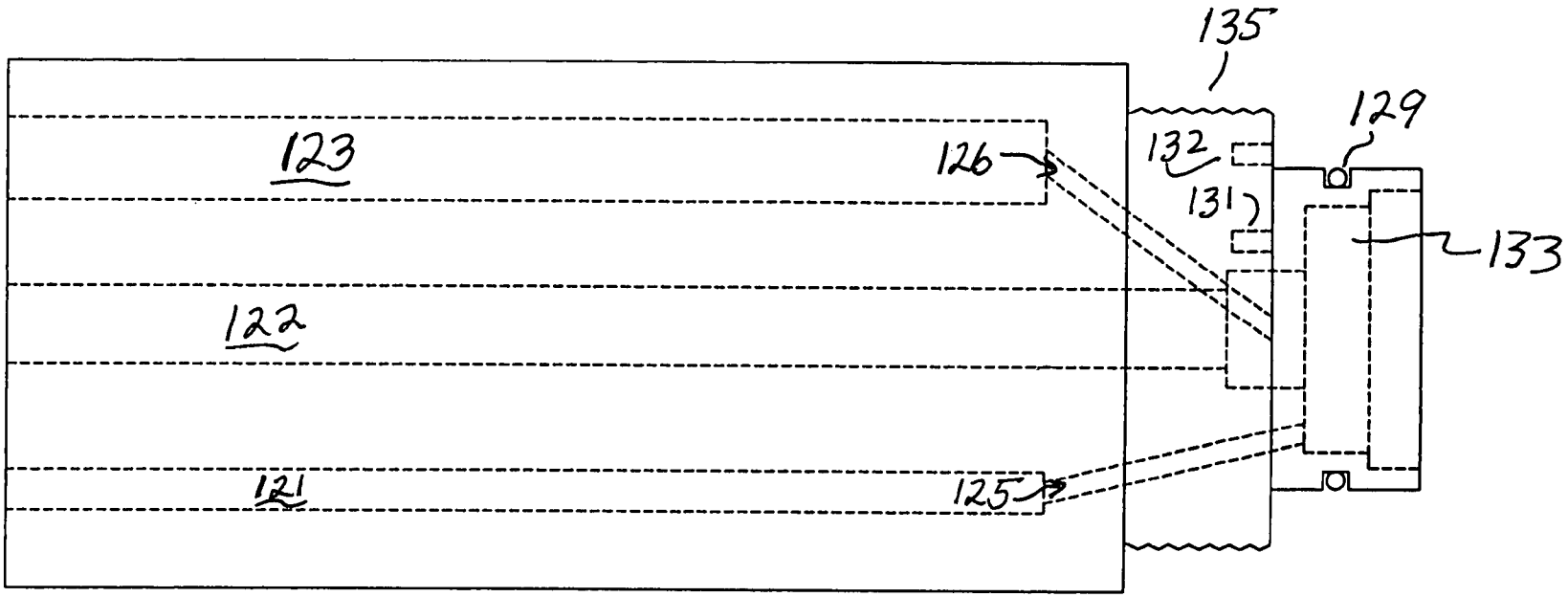
FIG. 6 is a side elevational view illustrating the gun body.
Figure 7:
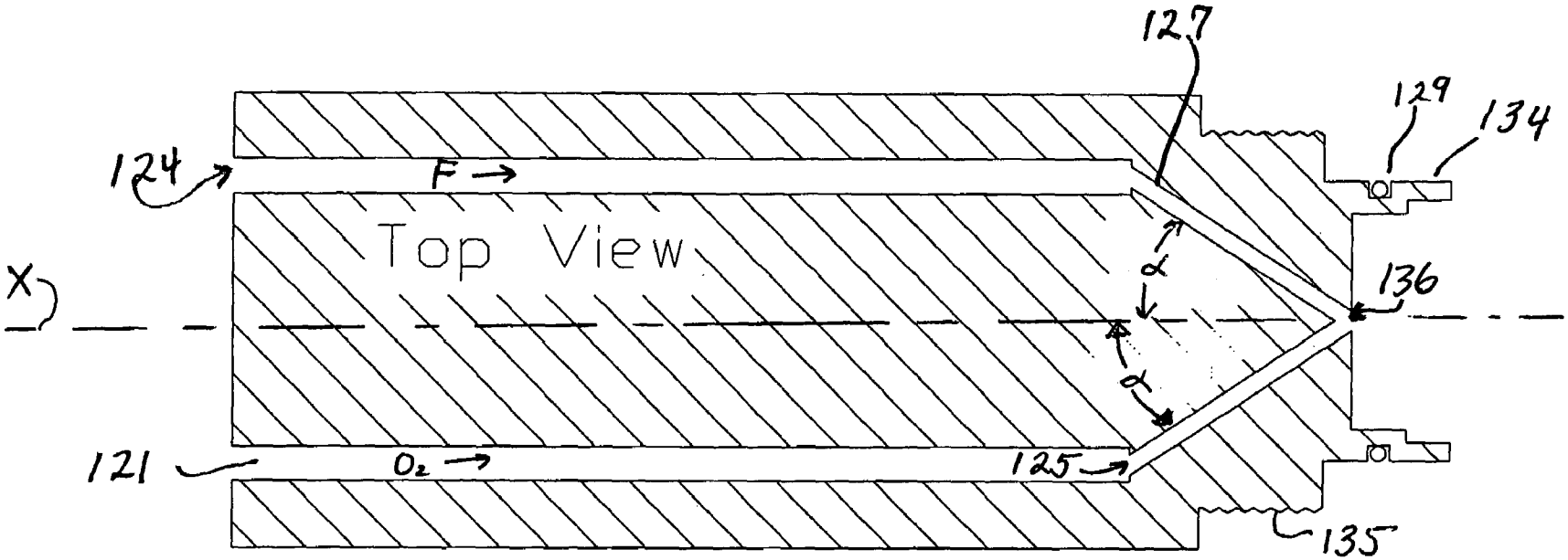
FIG. 7 is a sectional plan view illustrating the fuel and oxygen channels of the gun body.
Figure 8:
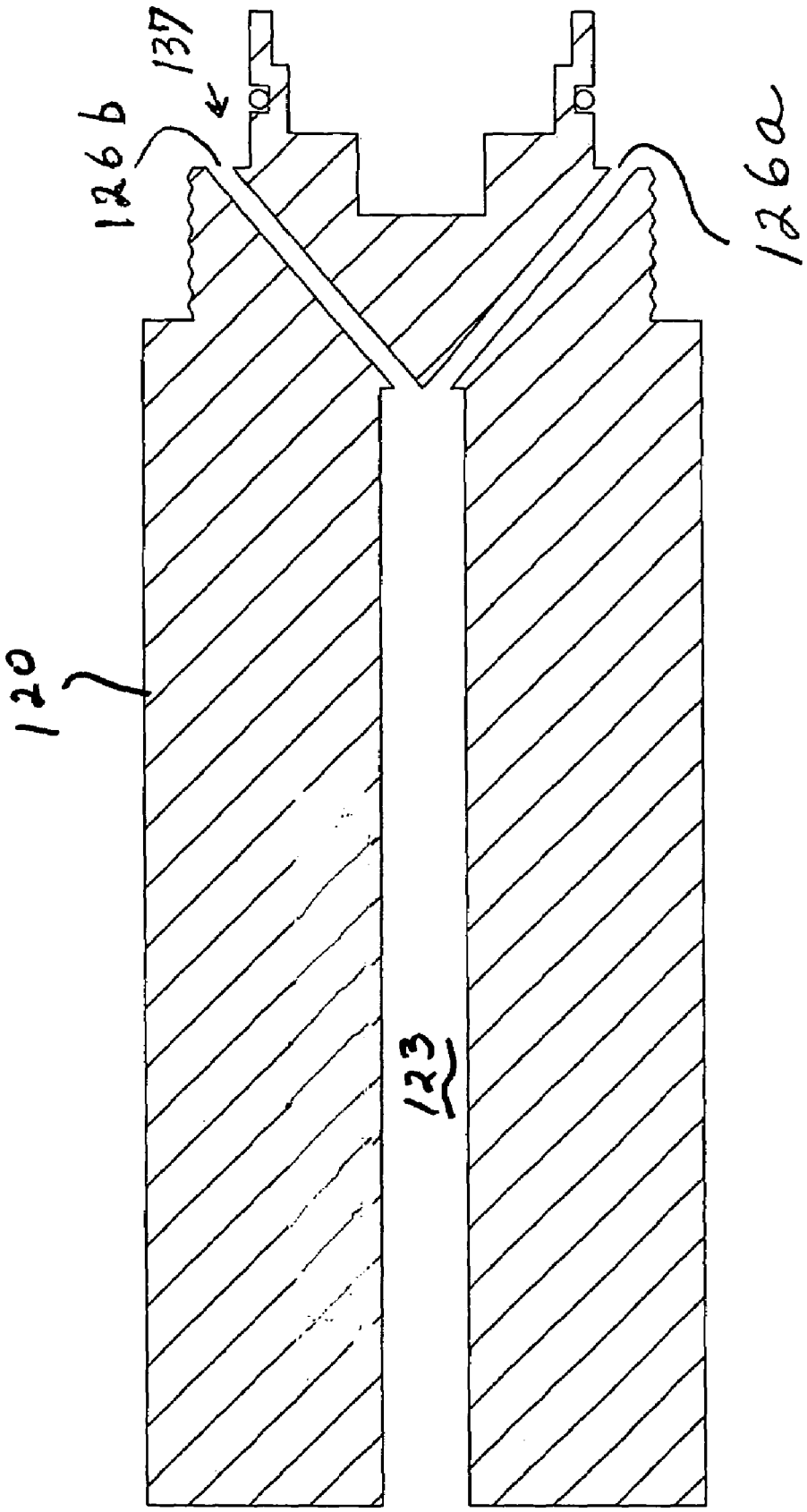
FIG. 8 is a sectional plan view illustrating the air channel of the gun body.
Figure 13:
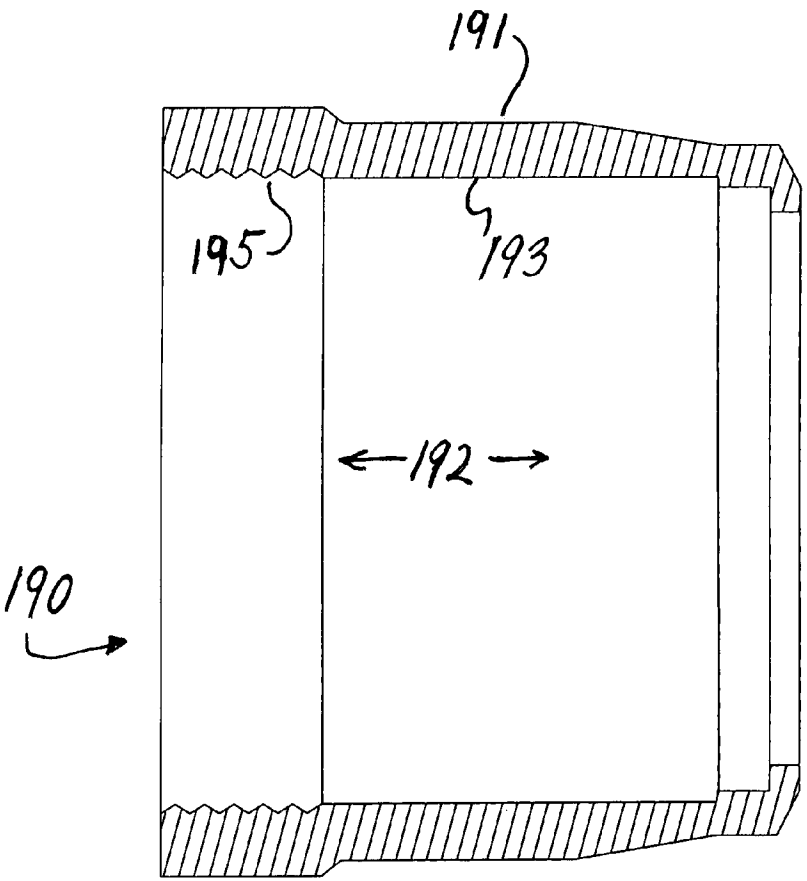

Referring to FIG. 13, air cap body 190 includes a generally ring shaped member 191 having an axial passageway 192. Inner surface 193 of the body includes a threaded portion 195 for screw engagement with threaded portion 135 of the gun body (FIGS. 6, 7). First annular air flow chamber 117 is at least partially defined by inner surface 193 of the air cap body and outer surface 176 of the air distributor cap 170 (FIG. 12B).

In operation, the coating material is passed through a flame of oxygen-fuel gas at the discharge end of the spray gun wherein it is melted into droplets. The flame is a jet flame formed by the compression wave provided by the compressed air directed at an angle inward towards the axis of the apparatus. The air streams discharged through the nozzle provide a thermal "cushion" to prevent the coating material particles from degradation by overheating. The separate control of the fuel supply F, oxygen supply O, compressed air A, and the first and second venturis 26 and 30 for the coating material supply CM, enable the user to have superior control of the spraying process. A wide variety of coating materials can be used with excellent efficiency and coating quality.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A thermal spray coating system comprising:

a) a spray gun applicator providing means for projecting coating material through a reduced temperature zone of a flame region and onto a substrate, the spray gun applicator including a gun body having an axial conduit for passage therethrough of coating material said gun body including a fuel gas supply conduit, an oxygen supply conduit, and a compressed air conduit, an assembly mounted to a distal end portion of the gun body including a nozzle having a plurality of first channels for distally ejecting streams of oxygen-fuel gas mixtures into the flame region to provide high temperature combustion gasses and having a plurality of second channels for distally ejecting streams of compressed air into the flame region to provide the reduced temperature zone, said nozzle further comprising an axial passageway for the passage therethrough of the coating material, a proximal stem portion and a distal flange portion, said flange portion including the plurality of first and second channels in alternating arrangement, the first channels extending longitudinally through the flange portion and the second channels respectively having a radially oriented portions with inlet openings disposed around a circumferential periphery of the flange portion and longitudinally oriented portions;

the assembly further including an air distributor cap having a plurality of ports for discharging compressed air distally in a direction angled inward towards the axis of the gun body and toward the flame region to provide a compression wave to rapidly melt the coating material; and b) means for supplying coating material to the spray gun applicator.

2. The thermal spray gun coating system of claim 1 wherein the first channels have respective distal outlets disposed in a generally circular arrangement at a distal end surface of the nozzle, and the longitudinally oriented portions of the second channels terminate in respective distal outlets disposed in a generally circular arrangement at the distal end surface of the nozzle, the circular arrangement of the outlets of the second channels being concentric to and smaller than the circular arrangement of the distal outlets of the first channels.

3. The thermal spray coating system of claim 1 wherein the means for supplying coating material comprises:

a fluidized bed of coating material particles;

first venturi means for transporting a stream of the coating material particles in compressed air from the fluidized bed;

second venturi means for receiving the stream of coating material particles from the first venturi means and transporting the stream of coating material particles to the spray gun applicator, wherein each of said first and second venturi means is independently controlled by respective individual streams of compressed air.

4. The thermal spray coating system of claim 3 wherein the coating material includes include zinc, aluminum, zinc-aluminum alloy, ferrous metal alloys, copper, copper alloys, or ceramics.

5. The thermal spray coating system of claim 3 wherein the coating material includes colorants, electrically conductive materials, fluorescent materials, phosphorescent materials, anti-fouling agents, reflectant materials, radar absorbent materials, or UV protectors.

6. The thermal spray coating system of claim 3 wherein the coating materials have a particle size range of from about 5 microns to about 500 microns.

7. The thermal spray coating system of claim 3 wherein the coating material comprises a thermoplastic or thermoset polymeric material.

8. The thermal spray coating system of claim 7 wherein the polymeric material is selected from the group consisting of epoxy resins, polyurethanes, nylons, polyesters, polycarbonates, polyethylene, polypropylene, acrylic polymers, PVC resins, fluorocarbon polymers, EVA, PEEK, PVDF, silicones and chemical or physical combinations thereof.

9. A thermal spray gun applicator of claim 1 wherein said means for supplying coating material to the spray gun comprises a fluidized bed of the powder material particles contained within a housing;

a first venturi for transporting a stream of the powder material particles in compressed gas from the fluidized bed;

a second venturi for receiving the stream of powder material particles from the first venturi and ejecting the stream of powder material particles, wherein each of said first and second venturis is independently controlled by a respective individual stream of compressed gas.

10. The apparatus of claim 9 wherein the coating material includes include zinc, aluminum, zinc-aluminum alloy, ferrous metal alloys, copper, copper alloys, ceramics, carbon or graphite.

11. The apparatus of claim 9 wherein the powder material includes colorants, electrically conductive materials, fluorescent materials, phosphorescent materials, anti-fouling agents, reflectant materials, radar absorbent materials, anti-microbials or UV protectors.

12. The apparatus of claim 9 wherein the powder material particles have a size range of from about 5 microns to about 500 microns.

13. The apparatus of claim 9 wherein the powder material particles comprise a thermoplastic or thermoset polymeric material.

14. The apparatus of claim 13 wherein the polymeric material is selected from the group consisting of epoxy resins, polyurethanes, nylons, polyesters, polycarbonates, polyethers, polyethylene, polypropylene, acrylic polymers, PVC resins, fluorocarbon polymers, EVA, EAA, ABS, PEEK, PVDF, silicones and chemical or physical combinations thereof.

15. The thermal spray coating system of claim 1 wherein the assembly further includes a first annular chamber for vortex mixing of the fuel gas and oxygen, and a second annular chamber for the vortex mixing of fuel gas and oxygen flowing from the first annular chamber.

16. The thermal spray coating system of claim 1 wherein the spray gun applicator is portable and includes a handle grip.

17. A thermal spray gun applicator comprising:

a gun body having an axial conduit for passage therethrough of coating material, said gun body including a fuel gas supply conduit, an oxygen supply conduit, and a compressed air conduit, an assembly mounted to a distal end portion of the gun body including a nozzle having a plurality of first channels for distally ejecting streams of oxygen-fuel gas mixtures into a flame region to provide high temperature combustion gasses and having a plurality of second channels for distally ejecting streams of compressed air into the flame region to provide a reduced temperature zone, wherein the assembly further includes a first annular chamber for vortex mixing of the fuel gas and oxygen, and a second annular chamber for the vortex mixing of fuel gas and oxygen flowing from the first annular chamber and said nozzle further comprises an axial passageway for the passage therethrough of the coating material, a proximal stem portion and a distal flange portion, said flange portion including the plurality of first and second channels in alternating arrangement, the first channels extending longitudinally through the flange portion and the second channels respectively having a radially oriented portions with inlet openings disposed around a circumferential periphery of the flange portion and longitudinally oriented portions;

the assembly further including an air distributor cap having a plurality of ports for discharging compressed air distally in a direction angleded inward towards the axis of the gun body and toward the flame region to provide a compression wave to rapidly melt the coating material; and b) means for supplying coating material to the spray gun applicator.

* * * * *